United States Patent [19]

Ganz

[11] Patent Number: 4,549,731

[45] Date of Patent: Oct. 29, 1985

[54] CARTON BLANK TRANSFER MECHANISM

[76] Inventor: Robert H. Ganz, 8 Ridgecrest Rd., Saddle River, N.J. 07458

[21] Appl. No.: 428,901

[22] Filed: Sep. 30, 1982

[51] Int. Cl.[4] ..... B65H 3/08

[52] U.S. Cl. ..... 271/107; 271/11; 271/102

[58] Field of Search ..... 271/8 A, 11, 90, 91, 271/92, 93, 94, 95, 96, 99, 100, 102, 104, 107, 108, 98; 414/72; 221/211; 493/123, 124, 125, 107

[56] References Cited

U.S. PATENT DOCUMENTS

| | | | |
|---|---|---|---|
| 2,808,766 | 10/1957 | Larsen | 271/102 |
| 2,879,700 | 3/1959 | Richardson et al. | 493/123 |
| 2,924,156 | 2/1960 | Lloyd | 493/124 |
| 3,005,631 | 10/1961 | McVicker et al. | 271/102 |
| 3,053,529 | 9/1962 | Dunn | 271/107 |
| 3,287,011 | 11/1966 | Currie | 271/107 |
| 3,352,215 | 11/1967 | Wainberg | 271/107 |
| 3,352,216 | 11/1967 | Wainberg | 271/107 |
| 3,653,159 | 1/1972 | Keeler et al. | 271/98 |
| 4,081,945 | 4/1978 | Calvert et al. | 271/108 |
| 4,097,040 | 6/1978 | Dugh et al. | 271/107 |
| 4,149,452 | 4/1979 | Talarico | 493/107 |
| 4,218,054 | 8/1980 | Bauer et al. | 271/11 |
| 4,355,967 | 10/1982 | Hellmer | 271/107 |

FOREIGN PATENT DOCUMENTS

| | | | |
|---|---|---|---|
| 479901 | 1/1952 | Canada | 271/180 |
| 598302 | 9/1925 | France | 271/26 R |
| 927194 | 4/1947 | France | 271/26 R |
| 1049622 | 8/1953 | France | 271/26 R |
| 272281 | 12/1950 | Switzerland | 271/107 |

*Primary Examiner*—Bruce H. Stoner, Jr.
*Assistant Examiner*—James E. Barlow
*Attorney, Agent, or Firm*—Charles E. Brown

[57] ABSTRACT

This relates to a transfer mechanism for transferring blanks from a hopper to a blank applying mechanism. Most particularly, the transfer mechanism includes an arm which is pivotally mounted and which arm carries at one end a suction head which is also pivotally mounted. A single drive shaft drives an eccentric which effects oscillation of the arm and a cam mechanism which effects oscillation of the suction head relative to the arm. The oscillation of the suction head relative to the arm is in the same direction as that of the arm whereby a blank carried by the suction head will rotate through a relatively great angle while the arm rotates or pivots through only a relatively small angle. For example, the arm pivot through an angle of 45° while the suction head pivots through an angle of 90° relative to the arm and thus through an arc of 135°.

4 Claims, 4 Drawing Figures

CARTON BLANK TRANSFER MECHANISM

This invention relates in general to new and useful improvements in transfer mechanisms, and more particularly to a transfer mechanism particularly adapted to transfer a blank, such as a carton blank, from a hopper to an associated carton applying and forming mechanism.

Most particularly, this invention relates to a transfer mechanism wherein a suction head is carried by a pivotally mounted arm and wherein the suction head is also pivotally mounted relative to the arm andd there are drive means for pivotally oscillating the arm and other drive means for oscillating the suction head relative to the arm so that there is relative pivoting of the suction head with respect to the arm. Most particularly, the invention relates to the driving of the arm and the suction head such that the suction head pivots relative to the arm in the direction of movement of the arm so that with limited pivoting of the arm, a relatively great rotation of the blank being transferred may be effected in timed relation to the pivoting of the arm.

Most particularly, there is a single drive shaft which carries an eccentric drive for pivoting the arm and a cam actuated drive for oscillating the suction head. Further, the arm is pivotally mounted on a rotating shaft which carries a drive wheel which, in turn, drives a driven wheel and the driven wheel, in turn, actuates a gear set so as to effect the pivoting of the suction head relative to the arm.

With the above and other objects in view that will hereinafter appear, the nature of the invention will be more clearly understood by reference to the following detailed description, the appended claims, and the several views illustrated in the accompanying drawings.

Figure 2:
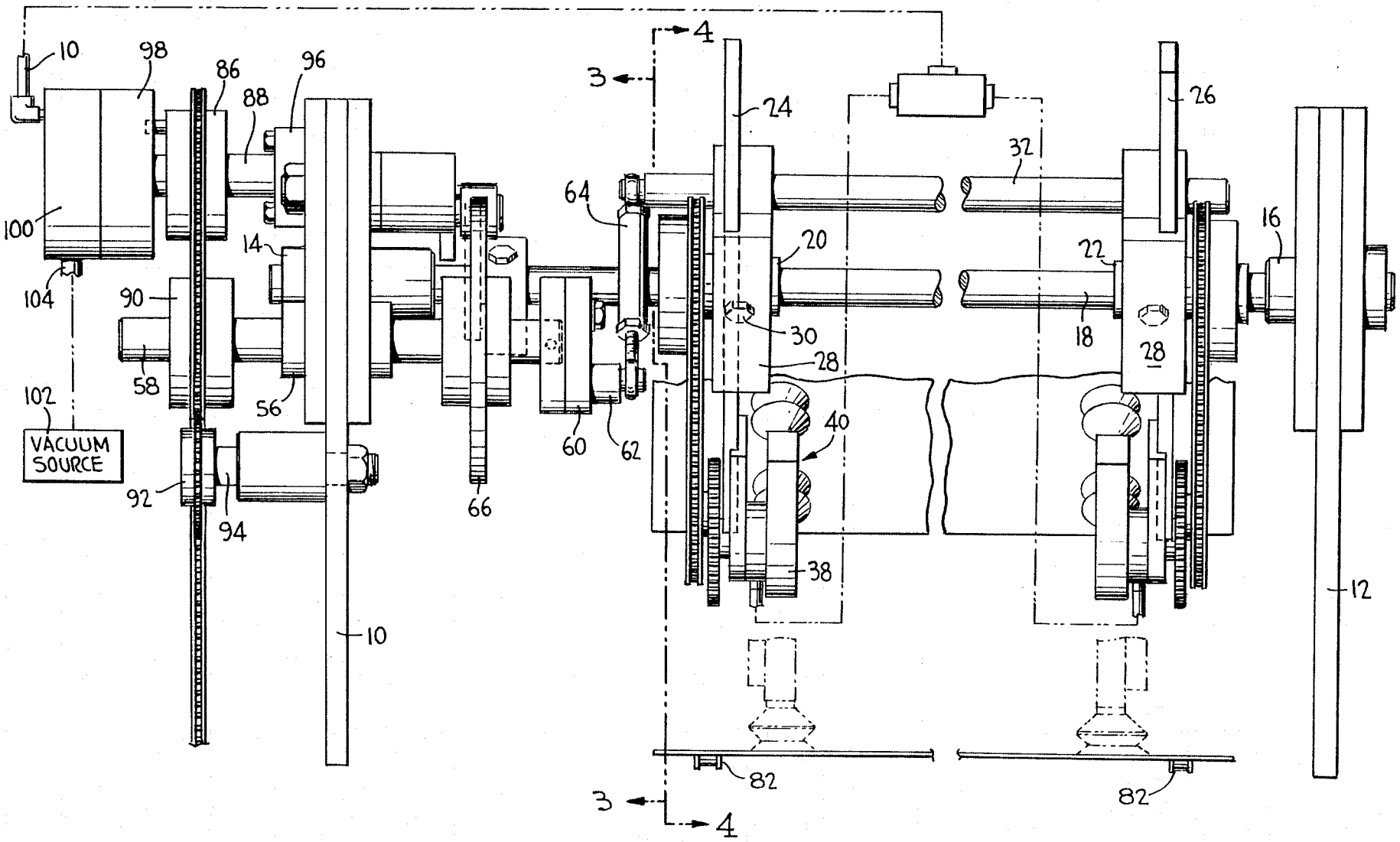
FIG. 2 is an elevational view of the mechanism of FIG. 1 taken generally along the line 2—2 of FIG. 1.
Figure 3:
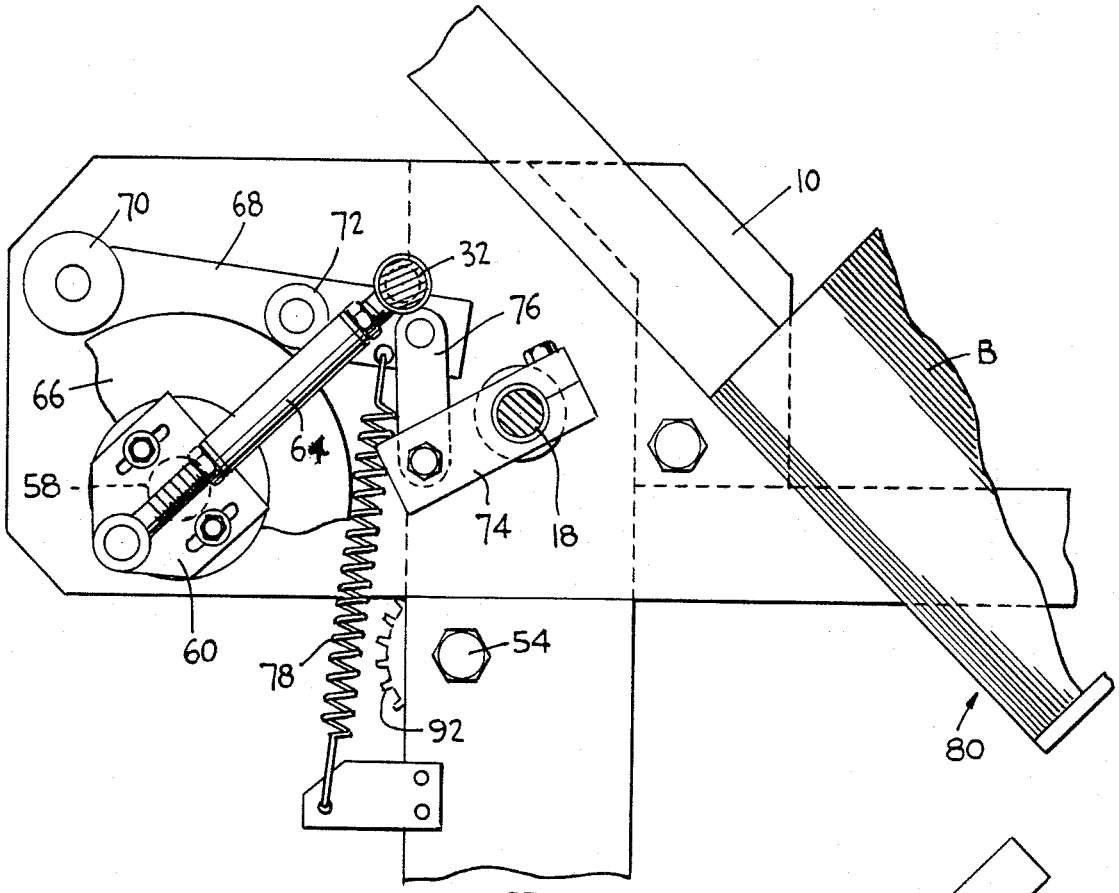
FIG. 3 is a vertical sectional view taken through the transfer mechanism generally along the line 3—3 of FIG. 2 and shows the drive for both effecting pivoting of the arm and for rotating the rotatable shaft on which the arm is pivotally mounted.

Referring now to the drawings in detail, reference is first made to FIG. 2 wherein there is illustrated two spaced apart vertical mounting plates 10 and 12. The mounting plates 10 and 12 carry horizontally aligned transverse bearings 14 and 16 in which there is rotatably journalled a transversely extending rotating shaft 18. The shaft 18 has rotatably journalled thereon bearings 20, 22 which, in turn, carry arms 24 and 26. It is to be noted that each arm 24 or 26, is carried by a mounting block 28 which is fixedly secured to a respective one of the bearings 20, 22, and the block 28 has the arm 24 slidably passing therethrough with the arm being locked in an adjusted position by means of a locking screw 30 (FIG. 2).

The mounting blocks 28 are joined together by a transverse shaft 32 to which the mounting blocks 28 are suitably fixed and so as to space apart the mounting blocks 28 and thus the arms 24, 26.

Each arm 24, 26 has an offset end portion 34 (FIG. 1) which carries a pivot shaft 36 which is rotatably journalled relative thereto. Each pivot shaft 36 carries a mounting block 38 of a suction head 40 with the mounting block being offset to one side of the respective arm, as shown in FIG. 2. The mounting block 38 is secured to its respective pivot shaft 36 for pivoting therewith and carries a plurality of suction cups 42.

Each arm 24, 26 also carries a driven shaft 44 adjacent its offset end. Each driven shaft 44 carries for oscillation therewith a drive sprocket 46 which is meshed with a driven sprocket 48 secured to the pivot shaft 36.

The driven shaft 44 also carries a driven wheel 50 in the form of a sprocket which is coupled to a drive wheel 52, also in the form of a sprocket, by a drive element in the form of a chain 54. Each drive wheel 52 is fixedly secured to the rotatable shaft 18 for oscillation therewith.

Referring once again to FIG. 2, it will be seen that the mounting plate 10 carries a bearing unit 56 in which there is rotatably journalled a drive shaft 58. The drive shaft 58 extends through the mounting plate 10 and carries on the end thereof adjacent the arm 24 an eccentric drive unit 60 including an eccentric pin 62. An adjustable link 64 extends between through the eccentric pin 62 and one end of the shaft 32. Thus, as the shaft 58 rotates and the eccentric drive member 60 rotates therewith, the adjustable link 64 causes oscillation of the interconnected arms 24, 26 from the solid line sloping position of FIG. 1 to a vertical position.

The drive shaft 58 also carries a cam 66. The cam 66 has associated therewith a follower mechanism which includes a lever 68 which is pivotally mounted on a pivot shaft 70 and carries at the center thereof a cam follower 72 which engages the cam 66. A crank arm 74 is adjustably clamped on one end of the rotatable shaft 18 and is connected to a free end of the lever 68 by means of a pivotal link 76. If desired, a tension spring 78 may be engaged with the lever 68 to retain the cam follower 72 in engagement with the surface of the cam 66.

It will thus be seen that the rotating shaft 58, when it rotates, serves not only to oscillate the arms 24, 26, but also to oscillate the suction head 40 relative to the arms.

Figure 4:
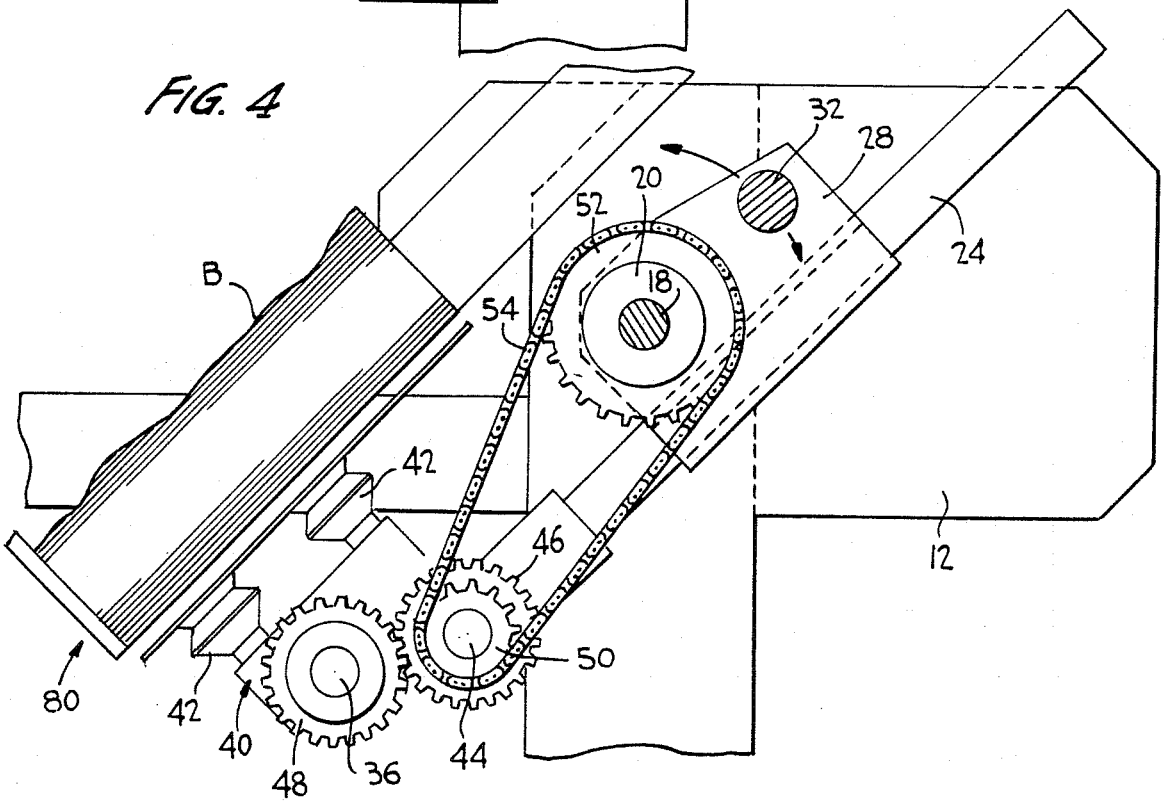
FIG. 4 is a vertical sectional view taken generally along the line 4—4 of FIG. 2 and shows the specific drive for effecting oscillation of the suction head relative to the arm as the arm pivots.

Referring once again to FIG. 4, it will be seen that the mechanism will include a suitable hopper 80 in which blanks B to be transferred are stored. The bottom blank faces downwardly generally at a 45° angle. The bottom blank, when transferred, will be transferred to a generally horizontal position. During the transfer of a blank from the hopper 80 to, for example, conveyor chains 82 (FIG. 2) of a carton applying mechanism, the arms 24, 26 pivot through an angle on the order of 45° while the suction heads 40 pivot relative to the arms 24, 26 through an angle of 90° in the same direction of pivoting of the arms 24, 26. It is to be understood that in the return movement of the arms 24, 26, the suction heads 40 will pivot or rotate in the opposite direction.

Figure 1:
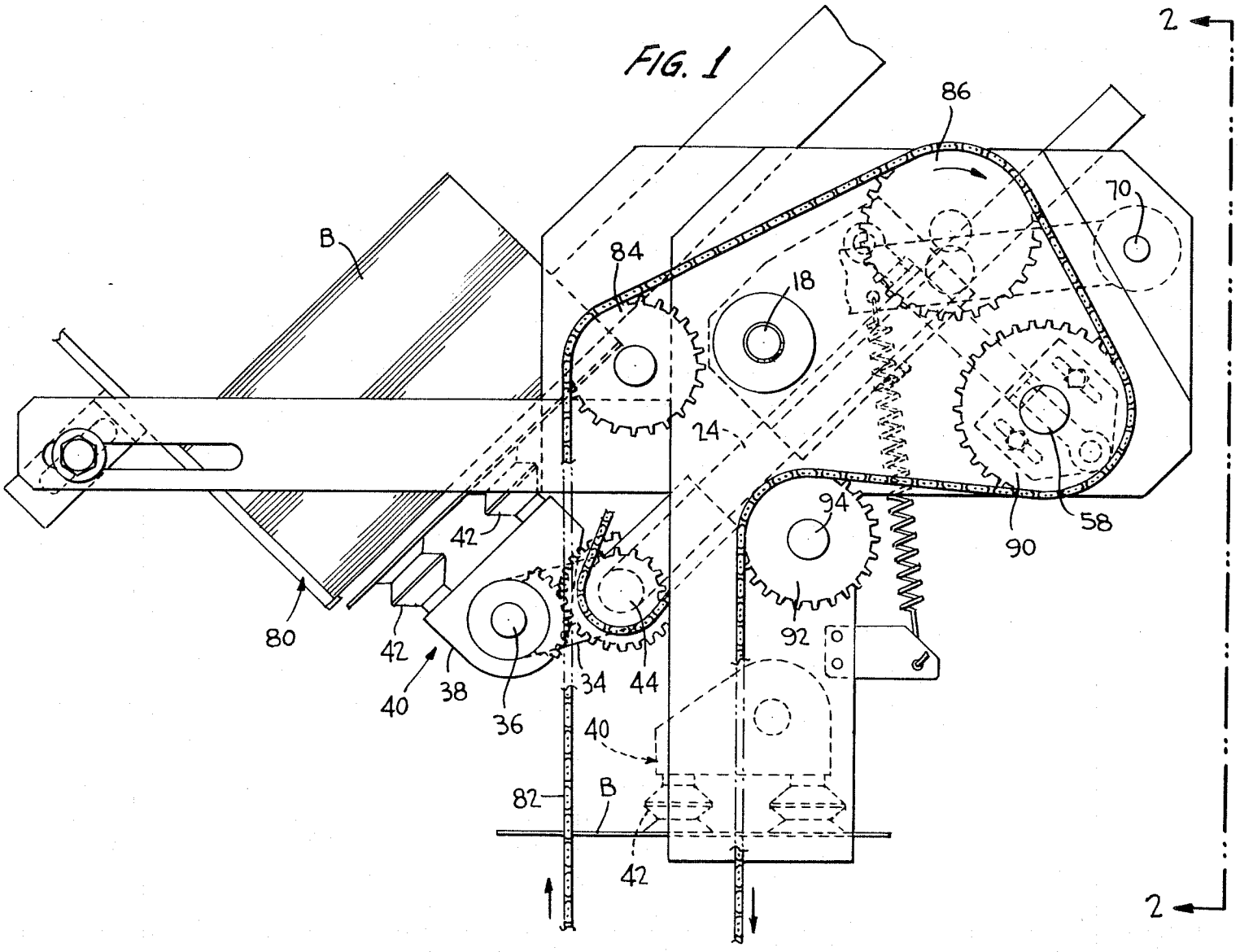
FIG. 1 is a side elevational view of the transfer mechanism and shows the general details thereof including the movement of a blank from a hopper to a discharge position.

Reference is now made to FIG. 1 with respect to the drive mechanism. The carton applying machine will include a suitable drive from which a chain 82 is driven in the direction of the arrows in FIG. 1. The chain 82 first passes over an idler sprocket 84 and then over a sprocket 86 which is carried by a shaft 88 (FIG. 2). The chain next passes over a sprocket 90 fixed to the shaft 58 and finally over an idler sprocket 92 carried by an idler shaft 94.

The shaft 88, which is rotatably journalled in a bearing 96 carried by the mounting plate 10 is provided with a rotary valve 98 which has a fixed housing 100 which is connected to a vacuum source 102 by a vacuum line 104 and to the suction head 40 by vacuum lines 106. Thus, the suction heads 40 are energized in time relation to the rotation of the shaft 58 and thus in timed relation to the pivoting of the arms 24, 26.

Although only a preferred embodiment of the blank transfer mechanism has been specifically illustrated and described herein, it is to be understood that minor variations may be made in the transfer mechanism without departing from the spirit and scope of the invention as defined by the appended claims.

I claim:

1. A carton blank transfer mechanism for transferring a carton blank from a hopper to a carton forming and applying apparatus, said transfer mechanism comprising a pivotally mounted arm, a suction head, means pivotally mounting said suction head on said arm for pivotal movement relative to said arm, said arm being mounted on a rotatable shaft, first drive means for oscillating said arm about said rotatable shaft, second drive means for separately oscillating said rotatable shaft in timed relation to oscillation of said arm, and third drive means between said arm and said suction head for oscillating said suction head relative to said arm, said means mounting said suction head on said arm including a pivot shaft secured to said suction head and being rotatable relative to said arm, a drive shaft carried by said arm adjacent said pivot shaft, and said third drive means including cooperating gears on said drive shaft and said pivot shaft, said drive shaft carrying a drive wheel and said rotatable shaft carries a drive wheel, and drive means connecting said drive wheels.

2. The transfer mechanism of claim 1 wherein said second drive means includes a main drive shaft, a cam carried by said main drive shaft, and cam following linkage connecting said rotatable shaft to said cam.

3. The transfer mechanism of claim 2 wherein said first drive means includes an eccentric carried by said main drive shaft, and a connecting rod directly connecting said eccentric to said arm for pivoting said arm about said rotatable shaft.

4. The transfer mechanism of claim 1 wherein said first drive means includes an eccentric carried by a main drive shaft, and a connecting rod directly connecting said eccentric to said arm for pivoting said arm about said rotatable shaft.

* * * * *